US007445589B2

(12) United States Patent
Jaen

(10) Patent No.: US 7,445,589 B2
(45) Date of Patent: Nov. 4, 2008

(54) MOLD FOR FORMING CARDBOARD BOXES

(75) Inventor: José Boix Jaen, Albatera (ES)

(73) Assignee: Los Pinos Finca Agricola, S.L., Torremendo (Alicante) (ES)

( * ) Notice: Subject to any disclaimer, the term of this patent is extended or adjusted under 35 U.S.C. 154(b) by 0 days.

(21) Appl. No.: 11/356,733

(22) Filed: Feb. 17, 2006

(65) Prior Publication Data

US 2006/0205579 A1 Sep. 14, 2006

Related U.S. Application Data

(63) Continuation of application No. 11/027,914, filed on Dec. 30, 2004, now abandoned, which is a continuation of application No. 10/310,648, filed on Dec. 5, 2002, now abandoned.

(30) Foreign Application Priority Data

Dec. 5, 2001 (ES) ..... 200102719

(51) Int. Cl.
*B31B 1/46* (2006.01)

(52) U.S. Cl. ..... 493/80; 493/81; 493/75; 493/79; 493/167; 493/174; 493/183

(58) Field of Classification Search ..... 493/56, 493/61, 73, 75, 79, 80, 81, 167, 169, 180, 493/183

See application file for complete search history.

(56) References Cited

U.S. PATENT DOCUMENTS 1,297,748 A * 3/1919 Streeper ..... 493/167
2,580,189 A * 12/1951 Pagendarm ..... 493/137
2,846,930 A * 8/1958 Gross ..... 493/128
2,919,633 A * 1/1960 Pierce, Jr. ..... 493/137
2,962,944 A * 12/1960 Neely ..... 493/116
3,115,073 A * 12/1963 Kreimendahl ..... 493/128
3,376,797 A * 4/1968 Scace ..... 493/139
3,513,757 A * 5/1970 Di Frank ..... 493/131
3,626,819 A * 12/1971 Hoyrup ..... 493/132
4,464,155 A * 8/1984 Collura et al. ..... 493/137
4,522,618 A * 6/1985 Stannard ..... 493/143
5,059,165 A * 10/1991 Wallin ..... 493/137
5,156,583 A * 10/1992 Baas ..... 493/140
5,193,328 A * 3/1993 Boriani et al. ..... 53/466
5,971,906 A * 10/1999 Tharpe et al. ..... 493/131
6,108,930 A * 8/2000 Griffin et al. ..... 34/117

* cited by examiner

*Primary Examiner*—Christopher Harmon
(74) *Attorney, Agent, or Firm*—Klauber & Jackson LLC

(57) ABSTRACT

Cardboard boxes are formed starting from a stamped sheet which is vertically pushed by a descending core (13) for folding the sectors (6) that are going to form the sides and those that are going to form the front ends (7), including equipment for folding of the extensions and/or flaps (8, 10) which are folded on the front ends and/or sides. The mold is intended to shape boxes having an upper horizontal bridge (9) in the sides (6), bridges presenting flaps (10) which fold over the front ends (7), being fixed to the outer face of them, with these front ends (7) in turn presenting end extensions (8) which are folded in the inner face of the sides (6). The mold includes runners (11) adjustable in height, permitting to fold the end extensions (8) of the front ends (7), also having wedges in ramp (14) and presses (15) with an inclined plane (16), for folding the flaps (10) of the upper bridges (9) of the sides (6), these flaps (10) being folded on the front ends (7).

11 Claims, 5 Drawing Sheets

MOLD FOR FORMING CARDBOARD BOXES

The present application is a Continuation of Non-Provisional application Ser. No. 11/027,914, filed Dec. 30, 2004 now abandoned, which in turn is a Continuation of Non-Provisional application Ser. No. 10/310,648, filed Dec. 5, 2002, now abandoned which in turn, claims priority from Spanish Application Ser. No. 200102719, filed Dec. 5, 2001. Applicants claim the benefits of 35 U.S.C. §120 as to the Non-Provisional Application and priority under 35 U.S.C. §119 as to said Spanish application, and the entire disclosures of both applications are incorporated herein by reference in their entireties.

OBJECT OF THE INVENTION

As stated in the title of this descriptive specification, the present invention refers to a mold for forming cardboard boxes, which presents a series of features permitting strengthening to be carried out of cardboard boxes provided with an upper horizontal bridge in correspondence with its larger sides.

The object of the invention is to provide a mold intended to strengthen cardboard boxes starting from a sheet with sectors that will determine the base, the front ends with end extensions that fold on the inner face of the sides, and the sides themselves provided with a longitudinal extension determining an upper horizontal bridge with end flaps that are folded and fixed on the outer face of the front ends. The mold of the invention presents certain characteristics on the basis of which the strengthening of this type of cardboard box can be carried out without any difficulty, even with different heights of box.

BACKGROUND OF THE INVENTION

The use of cardboard boxes for fruits and other perishable products is currently notably widespread, and the number of boxes that are manufactured is therefore high.

As is also known, cardboard boxes are obtained from a sheet duly stamped out, with cutting and folding lines in order to be able to carry out the strengthening and the appropriate shaping of the box, a process that is performed by means of machines or molds into which the stamped out cardboard sheets are introduced one at a time in order to carry out the appropriate folding of its ends and flaps and obtain the corresponding box in each case.

Owing to the existence of various types of box, the machines or molds will have the appropriate elements for shaping the specific type of box that is intended.

In this regard, the fact can be highlighted that there exists a very characteristic type of box that includes a base, some larger sides, some front ends, some flaps for one and another wall for folding on contiguous ones, thus strengthening the box, and an upper horizontal bridge in correspondence with each side, in such a way that the two bridges determine a resistant means of support for permitting stable stacking of boxes.

The molds used in shaping this type of box include certain side guides in which the shaping components are mounted, provided with movement or displacement both longitudinal and transverse for being adapted to the dimensions of the box it is intended to shape, in such a way that the extended cardboard sheet is arranged among those shaping elements, these being adjusted to the dimensions of the contour which the box has to have, in order to then effect a downwards push of the sheet, which is done by means of a core resting on the sector that is going to form the bottom, this core descending and folding the sides and front ends, as well as the corresponding extensions and flaps.

In other words, the descent of the cardboard sheet entails pushing into the vertical position of the sectors forming the front ends and sides, while the flaps and/or extensions attaching on to the sides and/or the front ends, as well those which are going to form the upper horizontal bridges, are duly folded from the final positions so that the box becomes perfectly strengthened.

There are molds for shaping boxes in which the bridges are carried out on the front ends. However, when it is wished to form boxes with bridges in the larger sides it is necessary to effect a series of modifications or exchanges of elements or pieces of the mold so that, in most cases, it is more profitable for the manufacturer to have a second type of mold.

Nevertheless, molds are costly and imply a very considerable economic sum, because of which it would be useful to have a mold permitting both types of box to be shaped, in other words, those in which the upper horizontal bridges are located in correspondence with the sides or those where they are in correspondence with the front ends.

DESCRIPTION OF THE INVENTION

The mold forming the object of the invention is of the type referred to in the previous section, but with a series of improvements permitting strengthening of cardboard boxes with upper bridges in correspondence with their larger sides.

In this regard, one of the improvements of the mold consists of the incorporation of certain runners for carrying out the folding of the extensions which, deriving from the front ends, are attached and fixed by glue onto the sides, these runners being adjustable in height in order to permit, as well as folding of the said extensions, also folding above the flaps derived from the sides for their fixing on the front ends.

Another novelty of the mold consists of the fact that the folding of these flaps derived from the sides and which can be fixed on the front ends starts by means of the supporting of those flaps on some wedges in ramp, in such a manner that when the cardboard sheet descends by pushing of the core, the initial folding of those flaps first takes place, with said folding then continuing by means of some exchangeable presses provided with inclined planes for the final sliding.

Another improvement consists of the mold being provided with large spaces between the pieces which press on the sides and the supports for them, in order to permit movements of the flaps which emerge from the sides and back onto and are fixed to the front ends.

Another improvement consists of the fact that both the wedges and the presses carrying out the folding of the said flaps derived from the sides and which are fixed to the front ends are exchangeable in order to permit adaptation of their geometry to variations in shape of the box to be shaped at each moment.

Another improvement consists of the incorporation of a pair of fingers in an inclined arrangement, located on two opposing sides, preferably diagonally, in order to ensure that one of the flaps of the bridges folds after the other and thereby prevent their ends from touching, which could lead to their being blocked.

Another improvement consists of the presses for folding of the flaps of the sides on the front ends being subjected to two movements, one being the advance towards the box and the other being one of descent, in such a manner that when those presses make contact with the said flaps these flaps are pressed onto the front ends and they are in turn tensed, thus compelling them to adopt a position that is perfectly vertical and not oblique as traditionally occurs.

This movement is carried out by means of a cylinder conveniently mounted on the structure of the mold. Said cylinder operating a mechanism with the shape of a deformable parallelogram to which the respective press is connected, thereby creating both the horizontal displacement movement of it and the displacement in the downwards vertical direction, in accordance with the movement given to the cylinder in question.

BRIEF DESCRIPTION OF THE FIGURES

In order to complement the description given below, and with the aim of aiding a better understanding of the characteristics of the invention, this descriptive specification is accompanied by a set of drawings on the basis of which it will be easier to understand the innovations and improvements of the mold for the formation of cardboard boxes carried out in accordance with the object of the invention.

DESCRIPTION OF THE PREFERRED EMBODIMENT

Figure 1:
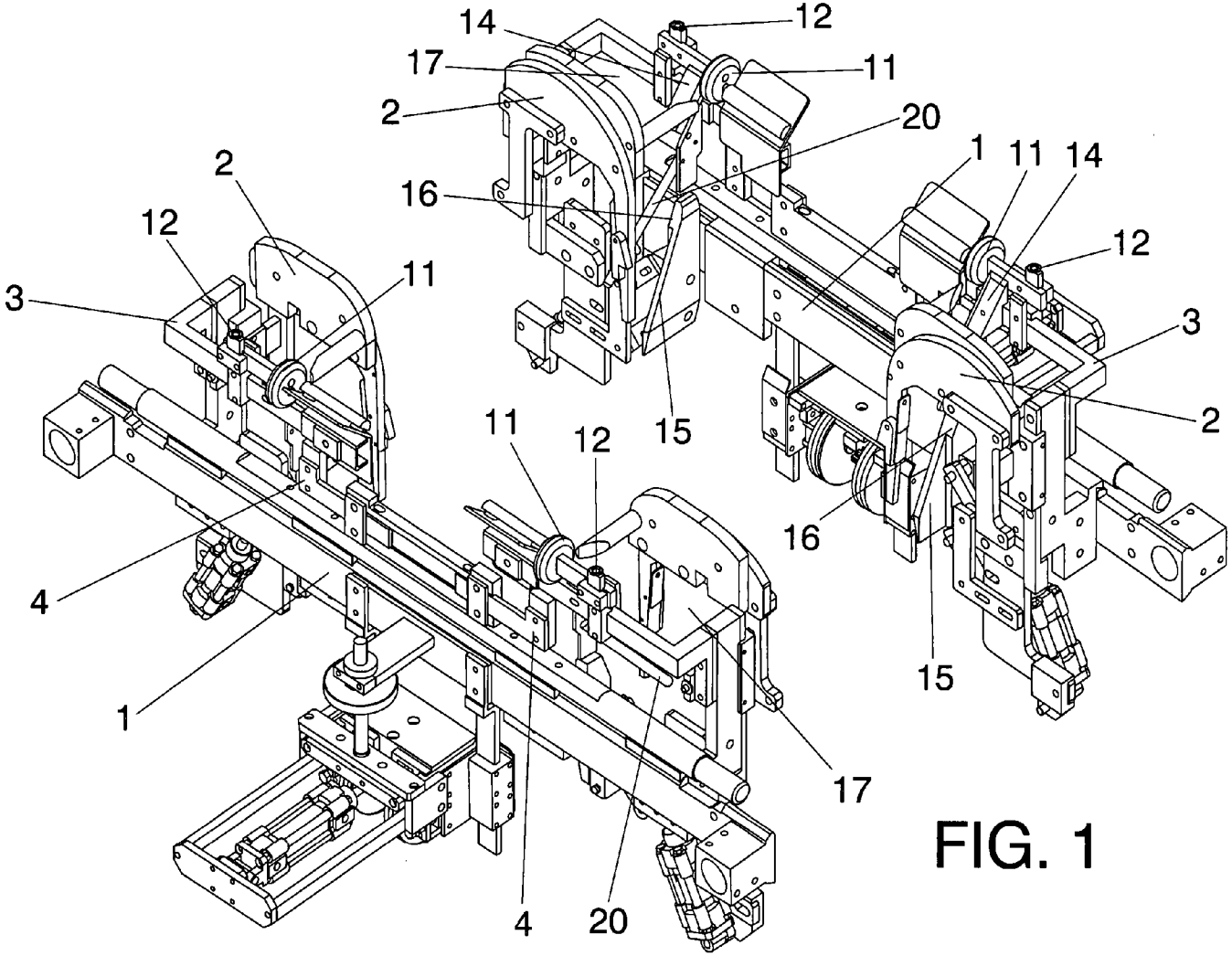
FIG. 1 shows a perspective view of the mold of the invention, in which can be seen all its main components as well as an arrow indicating the direction of entry of the cardboard sheet from which the box is going to be obtained.
Figure 2:
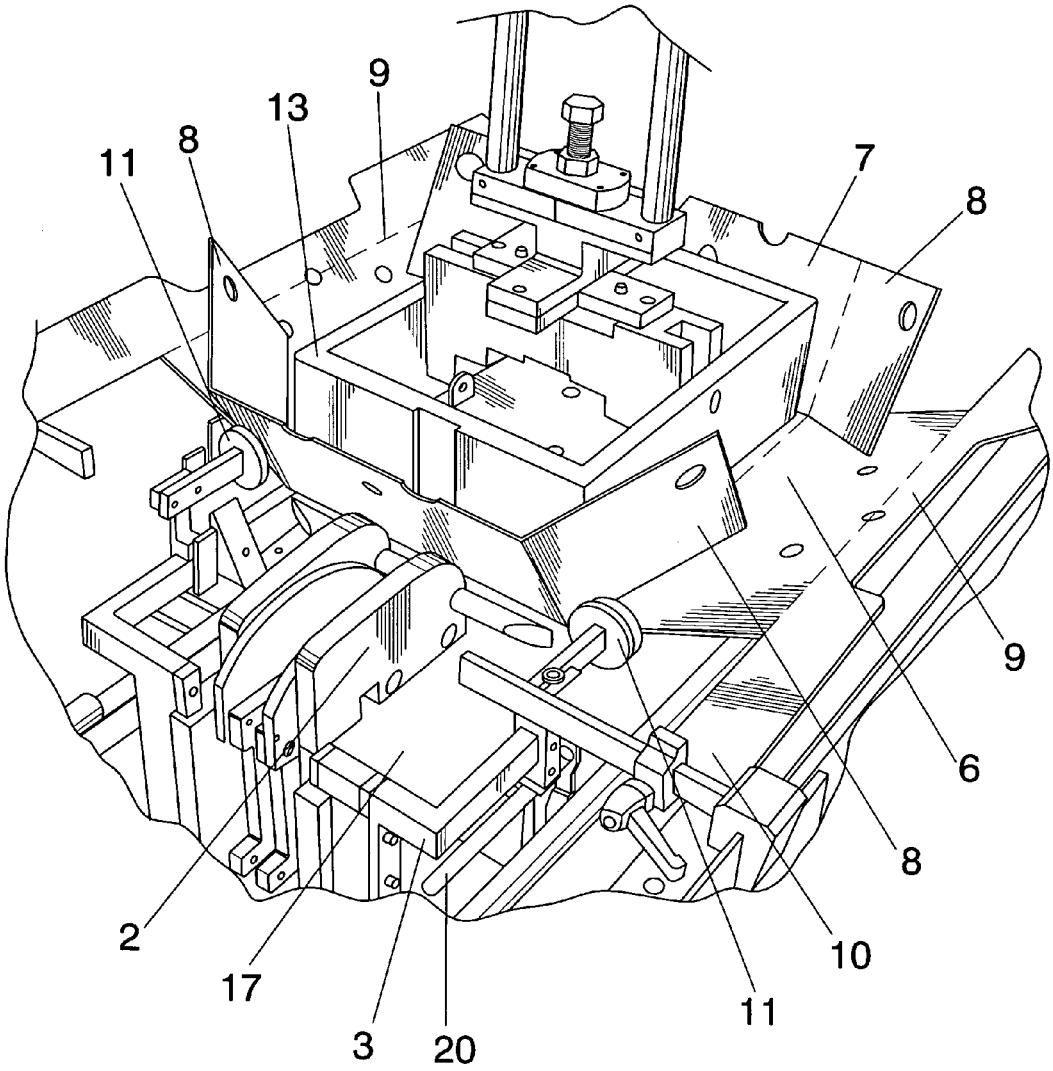
FIG. 2 shows a perspective view of the initial phase of shaping the box by means of the mold of the invention, in which the core can be seen pushing the sheet forming the box downwards and folding the sectors corresponding to the front ends and their extensions.
Figure 3:
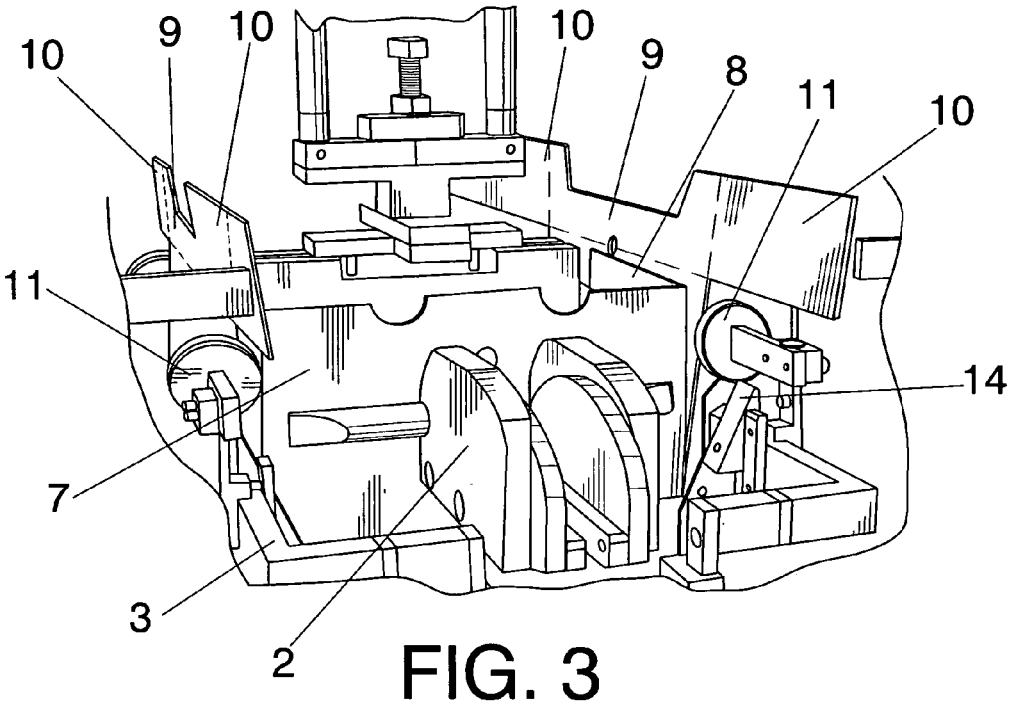
FIG. 3 shows a detail of a following phase of strengthening the box, in which the front ends can be seen in their fully vertical position along with the extensions of them and the sides in the position of elevation towards the vertical position of them.
Figure 4:
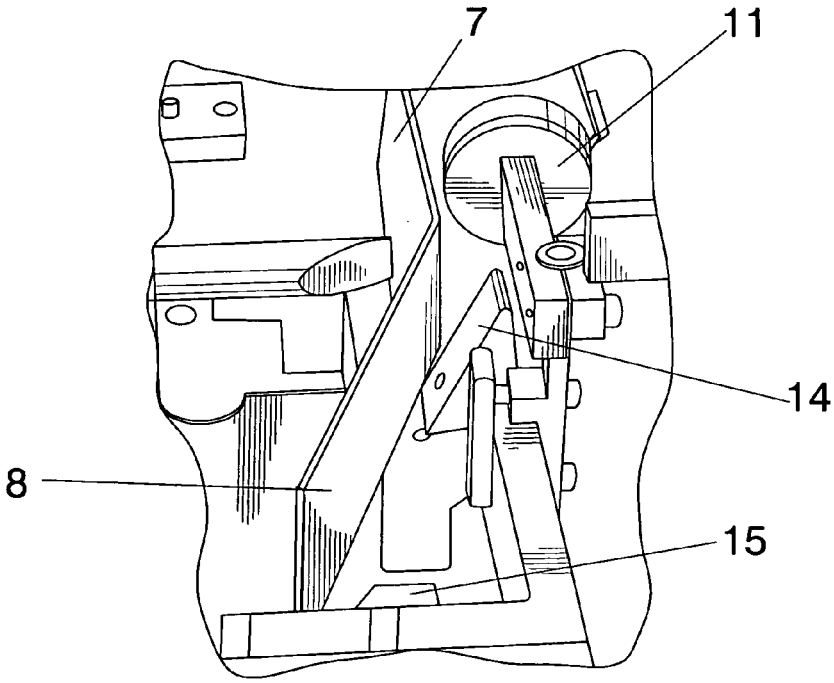
FIG. 4 shows a detail in perspective of one corner of the box in which can be seen the flap corresponding to the front end in a situation of folding towards the inside, by means of its sliding in its descent onto a wedge established for that purpose in the mold.
Figure 7:
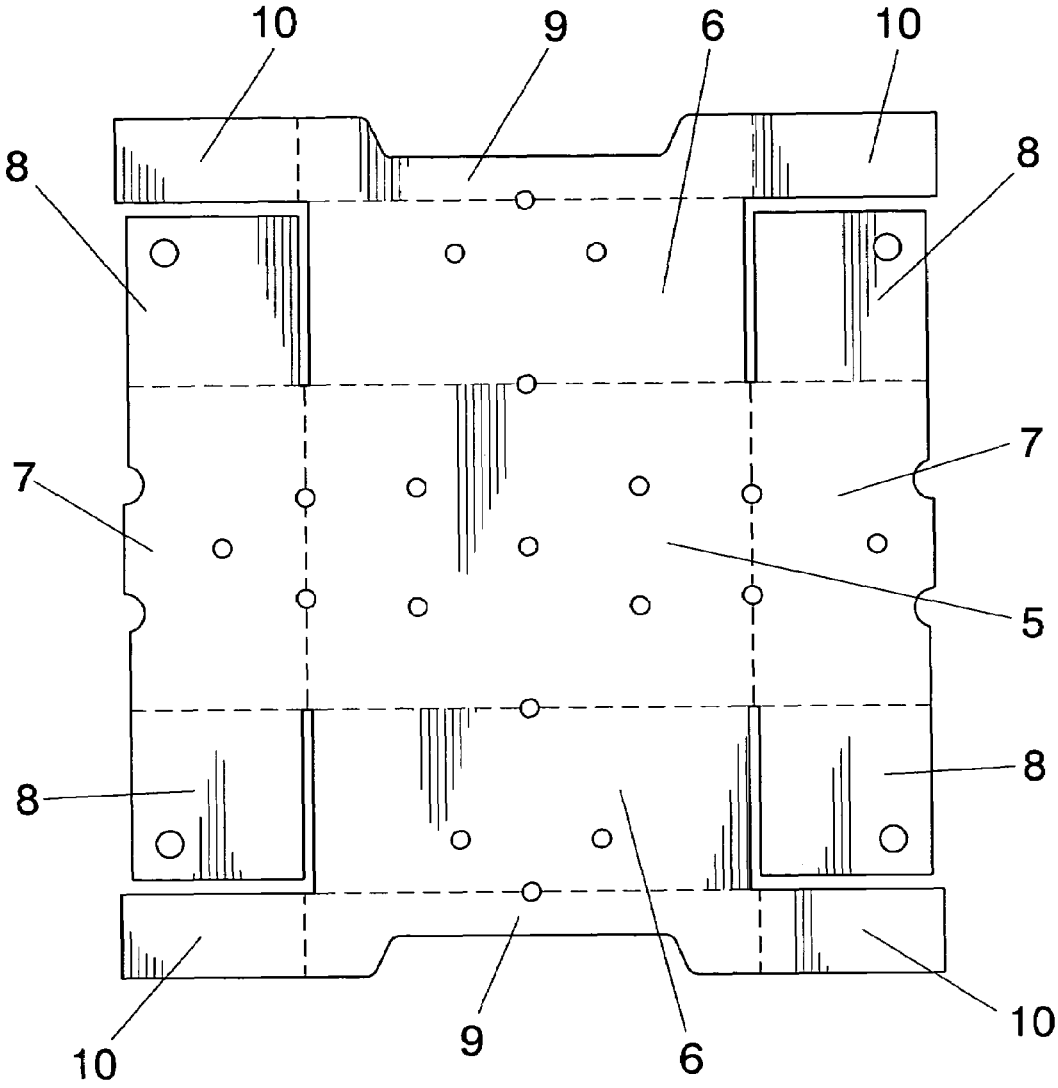
FIG. 7 shows the development corresponding to the stamped sheet of cardboard for obtaining the box by means of the mold of the invention.

In view of the said figures, it can be seen how the mold of the invention, intended for the shaping of cardboard boxes, includes a pair of frames 1 parallel to each other and able to be displaced towards and away from each other, in order to move respective shaping pieces 2 towards and away from each other, these shaping pieces 2 being mounted on supports 3 which are displaceable with respect to the frames 1, these supports 3 being connected to adjustable elements 4 permitting the displacement of those supports in order to duly shape the box, said box being obtained starting from a stamped cardboard sheet 5 as represented in FIG. 7, which is introduced into the structure of the said mold in accordance with the arrow indicated in FIG. 1. That sheet 5, starting from which the box is question is going to be obtained, includes a rectangular base corresponding to the actual reference 5, some longitudinal sectors 6 corresponding to the sides, some transverse sectors 7 corresponding to the front ends, some extensions 8 derived precisely from those front ends 7 and a longitudinal extension 9 which is derived from each of the sectors 6 corresponding to the sides, these longitudinal extensions 9 being in turn prolonged into end flaps 10, all this in such a way that in shaping the box the extensions 8 of the front ends 7 are attached onto the inner face of the sides and fixed to them by gluing, while the longitudinal extensions 9 of the sides themselves 3 are, in the shaping of the box, going to form the supper horizontal bridges, whose end flaps 10 are folded and remain attached externally onto the front ends and fixed to them by glue.

However, the structure of the mold represented in FIG. 1, in order to permit folding of the box and its shaping with the bridges 9 in correspondence with its sides 6, includes some circular runners 11 associated with height adjustment elements 12 for them, in other words, those runners 11 have the possibility of being adjusted in their height in order to achieve a higher or lower level with respect to the general structure of the mold, all this in such a manner that said runners 11 have the purpose that, when the cardboard sheet 5 descends pushed down by the core 13, they carry out the folding of the extensions 8 corresponding to the front ends 7, in such a manner that adjustment of these runners 11 is provided for permitting the flaps 10 corresponding to the bridges 9 to be advanced and folded above those runners, which enables the boxes to have a greater or lesser height.

The folding towards the inside of those flaps 10 is done by means of the wedges in ramp 14, on which those flaps 10 are supported and slide as the sheet 5 descends pushed by the core 13. The folding of those flaps 10 towards the inside is continued by means of some exchangeable pressing elements 15, with some upper inclined sections 16 for the final sliding of those flaps 10.

So, in the descent of the cardboard sheet 5 inside the mold, folding takes place of the extensions 8 of the front ends 7, along with folding towards the vertical both of those front ends 7 and of the sides 6. Similarly, folding of the flaps 10 is carried out, starting with folding towards the inside of the extensions that are going to constitute the bridges 9 of the box, in such a way that the folding of the extensions 9 towards their horizontal position causes the advance of the flaps 10 towards the vertical position and coplanar with the respective front end 7, with the ends of those flaps 10 crossing over on account of their large size.

However, in order to prevent those flaps 10 from interconnecting as they cross over, provision has been made so that the mold has some extra spaces 17 between pieces 2 and the mounting support 3 for them.

Moreover, provision has also been made for a pair of fingers 20 arranged preferably in diagonal opposition, which cause one of the flaps 10 of each bridge 9 to be folded in advance of the other, thus preventing the flaps 10 from being able to touch each other as they cross over, all of which has the aim of avoiding possible functioning or blocking faults of those flaps 10. Said fingers 20 are oriented towards the inside in an inclined manner.

Moreover, provision has also been made for both the wedges 14 and the presses 15 for folding of the extensions 8 to be exchangeable in order to be able to adapt their geometry to the variation and shape of the box intended to be obtained.

Figure 5:
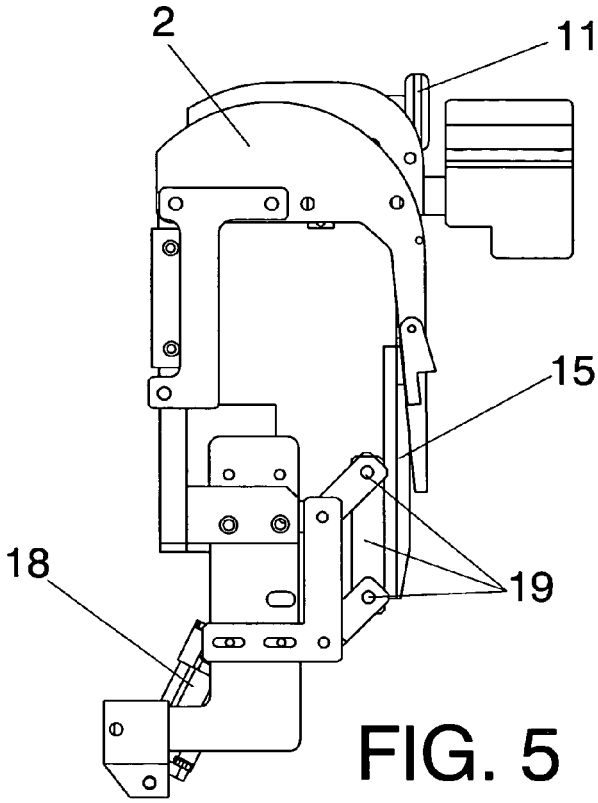
FIG. 5 shows a side view in detail corresponding to a press associated with the corresponding mechanism for carrying out movement or displacement, both horizontal and in the vertical descending direction of it.
Figure 6:
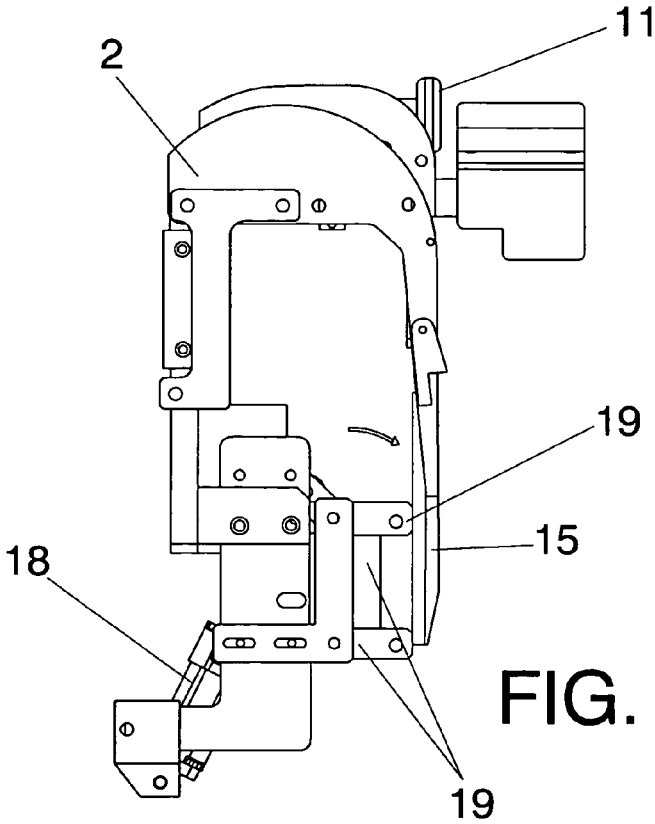
FIG. 6 shows another view like that of the previous figure, but in this case with the operating mechanism of the press activated, horizontal displacement of that press having taken place along with its vertical descent.

The presses 15, in addition to carrying out pressing of the flaps 10 to the front ends 7 also perform the folding of them, which is done by means of a double movement of those presses 15, one of advance towards the box itself and another of descent, so that, when making contact with the corresponding flap 10, the latter is pressed onto the front end and in turn tenses it thus compelling it to adopt the exact vertical position and preventing it from being able to remain at an oblique angle in its fixing to the actual front end, all this in such a manner that the double movement of displacement of the presses 15 is done by means of corresponding cylinders 18 which act on a mechanism 19 by way of a deformable parallelogram, to which is connected the press 15 in each case, as represented in FIGS. 5 and 6, so that the operation of that cylinder 18 causes articulated movement of that articulated mechanism or parallelogram 19 and therefore the displacement forwards and down of the press 15.

The invention claimed is:

1. A mold for forming cardboard boxes for permitting assembly of cardboard boxes which are provided with longitudinal extensions on their sides for forming upper horizontal bridges on said sides, the longitudinal extensions or bridges being prolonged on their ends having flaps which are folded and attached onto an outer face of corresponding front ends, said front ends in turn being prolonged on extensions which by folding are attached onto an inner face and being fixed on the sides, the mold having: a structure including two frames able to be displaced towards and away from each other; a plurality of pieces mounted on respective supports for folding sectors forming the front ends and sides of the box towards a vertical position; said mold essentially comprising: a plurality of circular runners associated with corresponding adjusting means for permitting to alter height of said runners, said runners folding the extensions corresponding to the ends of the box when the box is assembled; sliding wedges in ramp along which the flaps of the extensions slide so as to fold the flaps, the folding being continued by means of a plurality of presses with inclined portions for final folding of said flaps, said flaps when being folded passing above the circular runners after a gradual descent of the box inside the mold and a mechanical motion system having a deformable parallelogram mechanism to move said presses in two directional movements, one movement being an advance towards the box and the other movement being one of descent wherein said presses are moved into contact with the flaps to press the flaps onto the front ends and the front ends are in turn tensed.

2. The mold for forming cardboard boxes according to claim 1, wherein the pieces for folding the ends towards a vertical position are mounted on a support, an extra space provided permitting flaps to fold without contacting each other when the flaps cross over to be vertically positioned on the ends.

3. The mold for forming cardboard boxes according to claim 1, wherein the sliding wedges and the presses for folding extensions are exchangeable so as to adapt geometry to variations in shape of a corresponding box.

4. The mold for forming cardboard boxes according to claim 1, wherein the deformable parallelogram mechanism is operated by a cylinder so as to produce: a horizontal displacement movement of said presses and; a vertical descending movement so as to press the flaps and fixing the flaps to the corresponding ends.

5. The mold for forming cardboard boxes according to claim 1, further comprising two fingers inclined in a downwards direction toward the inside of the mold, so that one of the flaps for each bridge starts folding in advance of the other flap, preventing the two flaps for each bridge from contacting each other, said two fingers being located in two opposite points of the structure, preferably in diagonal opposition.

6. The mold for forming cardboard boxes according to claim 2, wherein the sliding wedges and the presses for folding extensions are exchangeable so as to adapt geometry to variations in shape of a corresponding box.

7. The mold for forming cardboard boxes according to claim 2, wherein the deformable parallelogram mechanism is operated by a cylinder so as to produce: a horizontal displacement movement of said presses and; a vertical descending movement so as to press the flaps and fixing the flaps to the corresponding ends.

8. The mold for forming cardboard boxes according to claim 3, wherein the deformable parallelogram mechanism is operated by a cylinder so as to produce: a horizontal displacement movement of said presses and; a vertical descending movement so as to press the flaps and fixing the flaps to the corresponding ends.

9. The mold for forming cardboard boxes according to claim 2, further comprising two fingers inclined in a downwards direction towards the inside of the mold, so that one of the flaps for each bridge starts folding in advance of the other flap, preventing the two flaps for each bridge from contacting each other, said two fingers being located in two opposite points of the structure, preferably in diagonal opposition.

10. The mold for forming cardboard boxes according to claim 3, further comprising two fingers inclined in a downwards direction toward the inside of the mold, so that one of the flaps for each bridge starts folding in advance of the other flap, preventing the two flaps for each bridge from contacting each other, said two fingers being located in two opposite points of the structure, preferably in diagonal opposition.

11. The mold for forming cardboard boxes according to claim 4, further comprising two fingers inclined in a downwards direction toward the inside of the mold, so that one of the flaps for each bridge starts folding in advance of the other flap, preventing the two flaps for each bridge from contacting each other, said two fingers being located in two opposite points of the structure, preferably in diagonal opposition.

* * * * *